United States Patent [19]

Franz

[11] 4,081,934

[45] Apr. 4, 1978

[54] SEASONABLY ADJUSTABLE WINDOW

[75] Inventor: Helmut Franz, Pittsburgh, Pa.

[73] Assignee: PPG Industries, Inc., Pittsburgh, Pa.

[21] Appl. No.: 791,350

[22] Filed: Apr. 27, 1977

Related U.S. Application Data

[63] Continuation of Ser. No. 720,184, Sep. 3, 1976, abandoned.

[51] Int. Cl.[2] ..... E06B 3/24

[52] U.S. Cl. ..... 52/171; 52/616; 428/333

[58] Field of Search ..... 52/171, 172, 397–399, 52/403, 616; 237/1 A; 126/270, 271; 350/1; 117/33.3, 35, 136

[56] References Cited

U.S. PATENT DOCUMENTS

| | | | |
|---|---|---|---|
| 1,974,739 | 9/1934 | Fraps | 52/171 |
| 2,164,815 | 7/1939 | Hadjisky | 52/304 |
| 2,631,339 | 3/1953 | Pratt | 49/64 |
| 2,834,999 | 5/1958 | Taylor et al. | 52/172 |
| 2,889,591 | 6/1959 | Pratt | 160/107 |
| 2,918,709 | 12/1959 | Corcoran | 49/390 |
| 3,332,192 | 7/1967 | Kessler et al. | 52/538 |
| 3,457,138 | 7/1969 | Miller | 52/616 X |
| 3,460,303 | 8/1969 | Algrain et al. | 52/314 |
| 3,591,248 | 7/1971 | Meunier et al. | 350/1 |
| 3,846,152 | 11/1974 | Franz | 117/33.3 |
| 3,925,945 | 12/1975 | White | 52/171 |
| 3,990,429 | 11/1976 | Mazzoni et al. | 52/172 X |

FOREIGN PATENT DOCUMENTS

| | | |
|---|---|---|
| 957,373 | 5/1964 | United Kingdom. |

*Primary Examiner*—J. Karl Bell
*Attorney, Agent, or Firm*—Donald Carl Lepiane

[57] ABSTRACT

A seasonably adjustable window includes four glass sheets mounted in spaced relationship and sealed at their marginal edges to provide dead airspaces therebetween. The outer glass sheets are selectively coated to provide the window (1) with a shading coefficient of less than 0.20 in the summer position and greater than about 0.25 in the winter position and (2) with a 50 percent reflectance to low temperature radiation, e.g. in the wavelength of greater than 3 microns in the winter position. The U-value of the window is less than 0.250 BTU/hour-square foot-° F.

25 Claims, 4 Drawing Figures

SEASONABLY ADJUSTABLE WINDOW

This is a continuation of application Ser. No. 720,184, filed Sept. 3, 1976 now abandoned.

BACKGROUND OF THE INVENTION

1. Field of the Invention:

This invention relates to a pivotally mounted, seasonably adjustable window to minimize passage of solar energy in a first position, e.g. the summer position, and to minimize low temperature radiation heat loss in a second position, e.g. the winter position.

2. Discussion of the Prior Art:

It has been recognized in the prior art that more efficient use of energy for heating or cooling the interior of residential or commercial buildings can be attained by using different types of insulating windows.

In U.S. Pat. Nos. 2,631,339; 2,889,591; and 2,918,709 there are taught windows having a louvre screen to minimize passage of solar energy. Although the windows taught in the above-mentioned patents are suitable for reducing the passage of solar energy, there are drawbacks. For example, having a louvred screen minimizes the vision area of the window and in the instance when the screen is completely closed, there is no vision area.

In U.S. Pat. Nos. 1,974,739; 2,164,815; and 3,925,945 there is taught the use of windows that are selectively coated to selectively pass solar energy. In U.S. Pat. No. 3,925,945 the window is reversible for seasonal adjustment. In general, each of the windows are provided with opposed openings to move air therethrough. The air as it passes through the window may be used to heat the room or to cool the window.

Each of the windows taught in the above-mentioned patents have drawbacks, namely, facilities have to be provided for moving air through the window to maximize the efficiency of the window. External air blowers require energy to operate thereby decreasing the total amount of energy saved. Further the air passing through the windows soils the glass surfaces. In order to clean the interior of the window, they are (1) disassembled or (2) cleaned with special equipment.

Other types of windows for minimizing room heat loss or reducing passage of solar energy include selectivily coating the glass. Examples of this type of window may be found in U.S. Pat. Nos. 3,332,192; 3,457,138 and 3,591,248 and U.S. Pat. application Ser. No. 672,562 filed in the names of J. S. Chess; J. A. Davis and R. G. Spindler on Mar. 31, 1976 for "Heat Reflecting Window" and assigned to the assignee of the instant application.

One of the limitations of the windows taught in the above-mentioned patents and patent application is that the windows are efficient for either reducing the passage of solar energy or minimizing the loss of room temperature radiation, but are not efficient for both.

It would be advantageous therefore to provide a seasonably adjustable window that does not have the limitation and drawbacks of the prior art.

SUMMARY OF THE INVENTION

This invention relates to a seasonably adjustable window including a first, second, third and fourth transparent substrates. Facilities are provided for sealing the marginal edges of the substrates to provide moisture-free dead airspaces between the first and second substrates; the second and third substrates; and the third and fourth substrates and to provide a first half including the first and second substrates and a second half including the third and fourth substrates. A first selective coating is provided on the first half of the window and a second selective coating is provided on the second half of the window. The first and second selective coatings provide the window in a first position, e.g. summer position, with a Shading Coefficient of less than about 0.20 and a U-value of less than 0.250 BTU/hour-square foot-° F. and provide the window in the second position, e.g. winter position, with a Shading Coefficient of greater than about 0.25 and a U-value of less than 0.250 BTU/hour-square foot-° F. and about 50 percent reflectance to low temperature radiation in the wavelength of greater than 3 microns.

DESCRIPTION OF THE INVENTION

This invention relates to a seasonably adjusted window that may be selectively positioned in a wall opening to (1) (a) provide shading against incident solar energy and (b) minimize heat conduction and convection in a first position and (2) provide (a) reduced shading against incident solar energy; (b) reflection of low temperature radiation and (c) minimize heat conduction and convection in a second opposite position.

Figure 1:
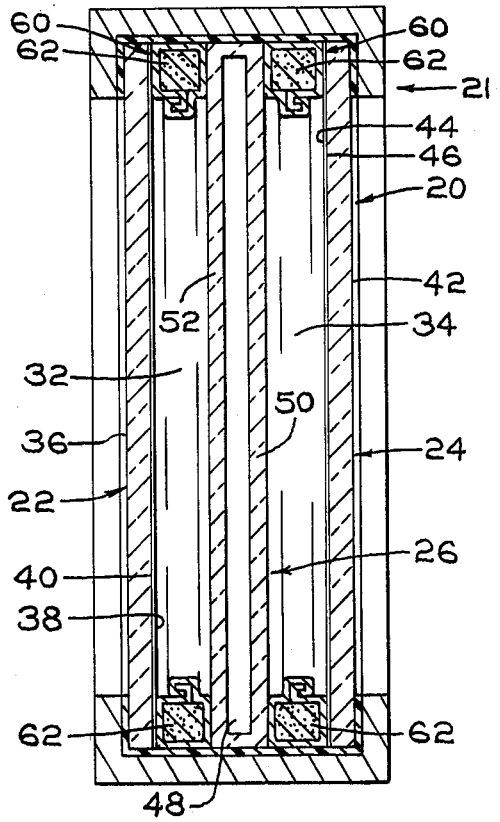
FIG. 1 is a cross-sectional view of a seasonably adjustable window incorporating features of the invention.

Referring to FIG. 1, there is shown a cross-sectional view of window 20 incorporating features of the invention mounted in a frame 21 in any conventional manner. In general, the window 20 includes transparent substrates or sheets 22 and 24 mounted in spaced relation and having their marginal edges sealed to an insulated unit 26 to provide moisture free, dead airspaces 32 and 34.

The substrates 22 and/or 24 may be made of any rigid transparent steel material, e.g. clear or colored glass or plastic. Preferably, the substrates are made of glass because of its scratch resistance, optical and thermal insulating properties.

The surfaces of the glass substrates 22 and/or 24 and/or of the insulated unit are selectively coated to provide the window with (1) a Shading Coefficient of greater than about 0.25 and preferably greater than about 0.30 in the winter position and a Shading Coefficient of less than about 0.20 and preferably less than 0.15 in the summer position; (2) 50 percent reflectance to low temperature radiation, i.e. infrared energy having a wavelength of greater than about 3 microns in the winter position and (3) a U-value of less than about 0.250 BTU/hour-square foot-° F. in the summer and winter positions.

The Shading Coefficient is defined as the ratio of the solar heat gain through a glazing system under a specific set of conditions to the solar gain through a single light of double-strength sheet glass under the same set of conditions. For a complete discussion, reference is made to Chapter 22 of ASHRAE Handbook of Fundamentals published 1972, which teachings are hereby incorporated by reference.

The U-value is defined as the overall coefficient of heat transmission or thermal transmittance (air to air) in BTU/hour-square foot-° F. U-values are determined in accordance to the teachings of Chapter 22 of ASHRAE Handbook of Fundamentals published 1972, which teachings are hereby incorporated by reference.

The discussion will now be directed to the preferred construction of the window 20. As will become apparent, the invention is not limited thereto and variations may be made in accordance to the teachings herein.

With continued reference to FIG. 1, the glass substrate 22 has an outer surface 36 and a coating 38 on inner surface 40. Shown in Table I are the preferred characteristics of the coated substrate 22 with respect to solar energy incident thereon.

TABLE I

Figure 3:
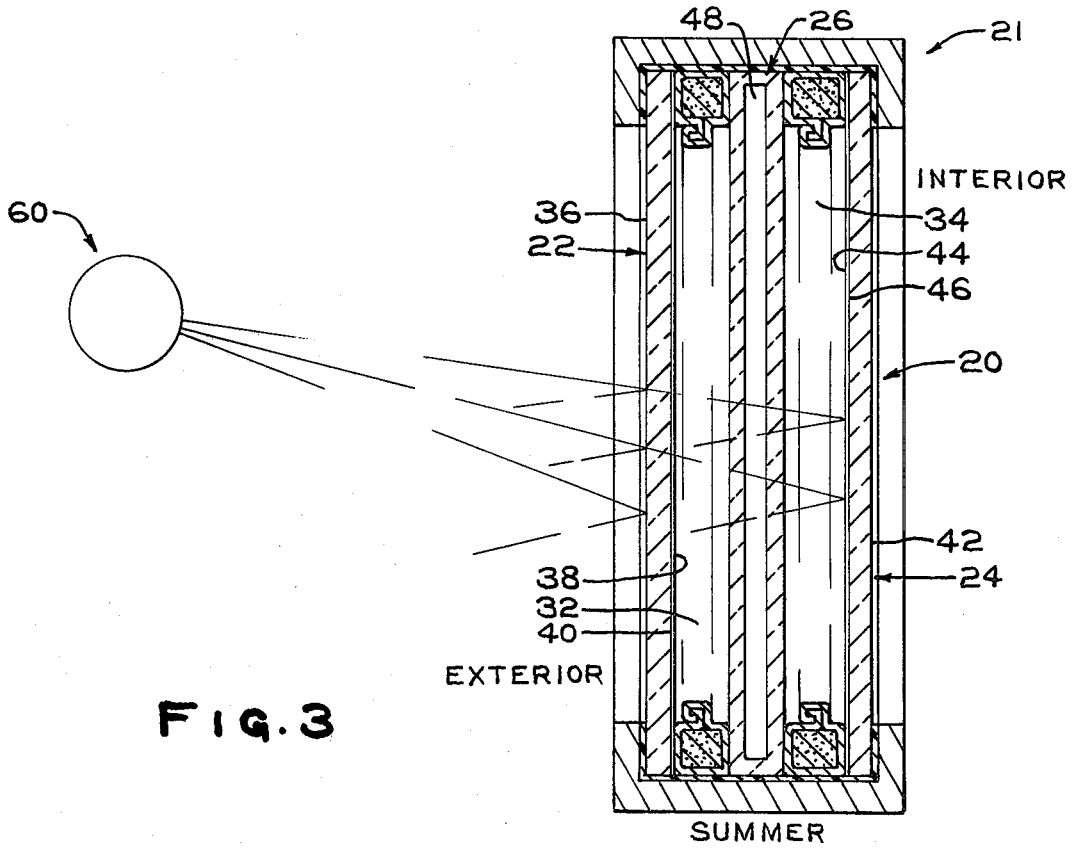
FIG. 3 is similar to FIG. 1 and illustrates the window in the summer position.
Figure 4:
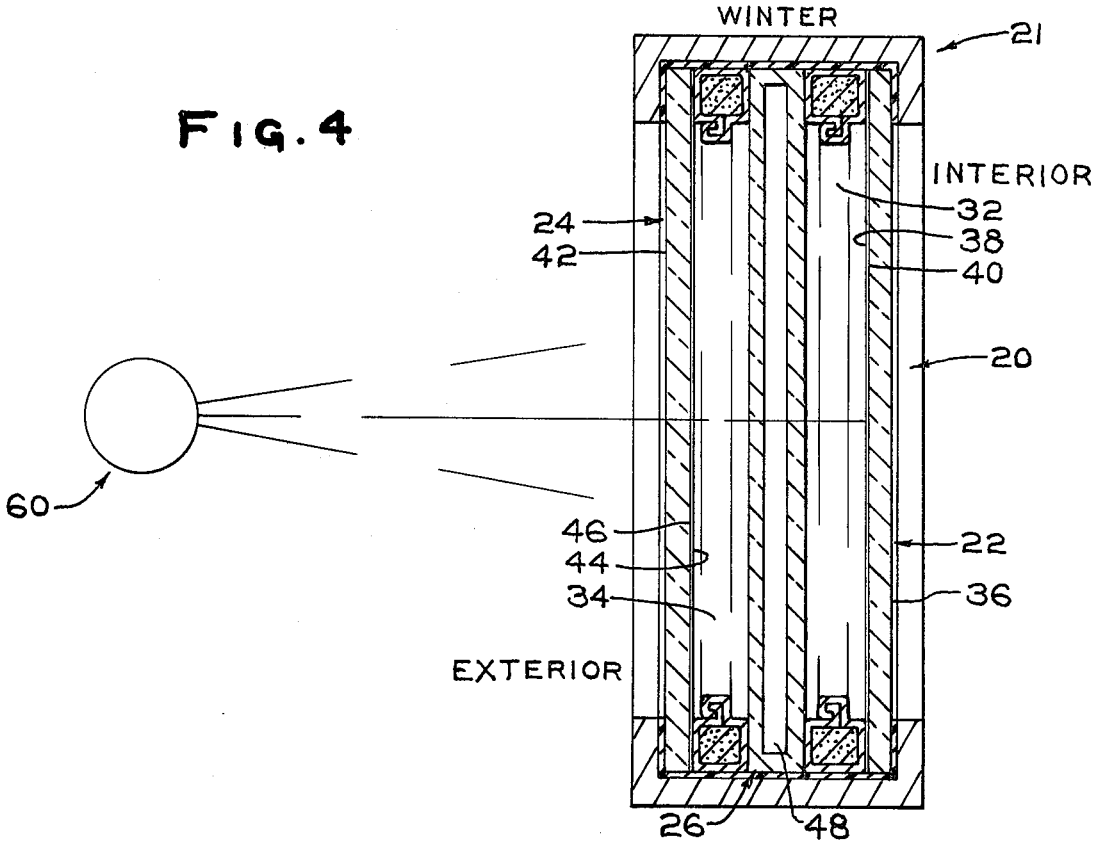
FIG. 4 is similar to FIG. 1 and illustrates the window in the winter position.

| Position of Substrate 22 | SOLAR ENERGY | | | | | |
|---|---|---|---|---|---|---|
| | Visible Range 0.3 - 0.8 microns | | | Infrared Range 0.8 - 15 microns | | |
| | Reflectance | Transmission | Absorption | Reflectance | Transmission | Absorption |
| Summer position as shown in FIG. 3 | 15-50% preferably about 40% | 5-50% preferably about 20% | remainder | at least 15% preferably more than 40% | less than 20% preferably less than about 10% | remainder |
| Winter position as shown in FIG. 4 | 15-50% preferably about 40% | 5-50% preferably about 20% | remainder | less than about 50% | greater than 0% | remainder |

Coatings that may be used in the practice of the invention to coat the substrate 22 but not limited thereto are metal films coated on a substrate and sold under the tradmark SOLARBAN® owned by PPG Industries, Inc., and taught in U.S. Pat. Nos. 3,457,138, 3,671,291 and 3,674,517. The teachings of U.S. Pat. Nos. 3,457,138; 3,671,291 and 3,674,517 are hereby incorporated by reference.

The substrate 24 has an outer surface 42 and a coating 44 on inner surface 46. Shown in Table II are the preferred characteristics of the coated substrate 24 with respect to solar energy incident thereon.

TABLE II

| Position of substrate 24 | SOLAR ENERGY | | | | | |
|---|---|---|---|---|---|---|
| | Visible Range 0.3 - 0.8 microns | | | Infrared Range 0.8 - 15 microns | | |
| | Reflectance | Transmission | Absorption | Reflectance | Transmission | Absorption |
| Summer position as shown in FIG. 3 | 10-15% | at least about 50% preferably more than 70% | remainder | greater than about 5% | less than about 50% | remainder |
| Winter position as shown in FIG. 4 | less than about 15% | at least about 50% preferably more than 70% | remainder | less than 10% | greater than about 40% | remainder |

Coatings to provide a transparent substrate having the properties of Table II that may be used in the practice of the invention but not limited thereto are tin oxide coatings taught in U.S. Pat. Nos. 2,724,658 and 3,107,177; indium oxide coating as taught in U.S. Pat. No. 3,907,660; and silver titanium oxide coatings taught in U.S. Pat. No. 3,962,488. The teachings of the above mentioned patents are hereby incorporated by reference.

The invention is not limited to the procedural steps for applying the coatings 38 and 44 to substrate surfaces 36 and 32, respectively. For example, but not limiting to the invention, the coatings 38 and 44 may be applied by sputtering as taught in U.S. Pat. No. 3,477,936; wet chemical coating as taught in U.S. Pat. No. 3,793,054; vapor deposition coating as taught in U.S. Pat. No. 3,850,679; pyrolytic oxide coating as taught in U.S. Pat. No. 3,660,061 and vacuum deposition. The teachings of the above-identified patents are hereby incorporated by reference.

The insulated unit 26 having a moisture-free, dry airspace 48 may be any of the types known in the art. In general, the unit 26 includes a pair of transparent sheets 50 and 52, for example, glass sheets, mounted in spaced relationship to one another and having their marginal edges sealed to provide the moisture-free, dead airspace 32. The unit 26 that may be used in the practice of the invention but not limited thereto are of the type having the marginal edges of the sheets welded together as taught in U.S. Pat. Nos. 3,268,316 and 3,683,974 and of the type having the marginal edges about a spacer frame and sealed as taught in U.S. Pat. Nos. 3,919,023; 3,832,254 and 3,791,910. The teachings of the above-identified patents are hereby incorporated by reference.

The U-value of the insulated unit 26 may be decreased by filling the dead airspace 48 or airspaces 32 and 34 with a gas, e.g. carbon dioxide and/or increase the spaced distance between the sheets 50 and 52.

Shown in Table III are the preferred characteristics of the insulated unit with respect to solar energy incident thereon.

TABLE III

| Position of Insulated Unit 26 | SOLAR ENERGY | | | | | |
|---|---|---|---|---|---|---|
| | Visible Range 0.3 - 0.8 microns | | | Infrared Range 0.8 - 15 microns | | |
| | Reflectance | Transmission | Absorption | Reflectance | Transmission | Absorption |
| Summer position as shown in FIG. 3 | less than 15% | at least about 80% | remainder | more than 10% | less than 80% | remainder |

TABLE III-continued

| Position of Insulated Unit 26 | SOLAR ENERGY Visible Range 0.3 - 0.8 microns Reflectance | Transmission | Absorption | Infrared Range 0.8 - 15 microns Reflectance | Transmission | Absorption |
|---|---|---|---|---|---|---|
| Winter position as shown in FIG. 4 | less than 15% | at least about 80% | remainder | less than 15% | more than 65% | remainder |

Figure 2:
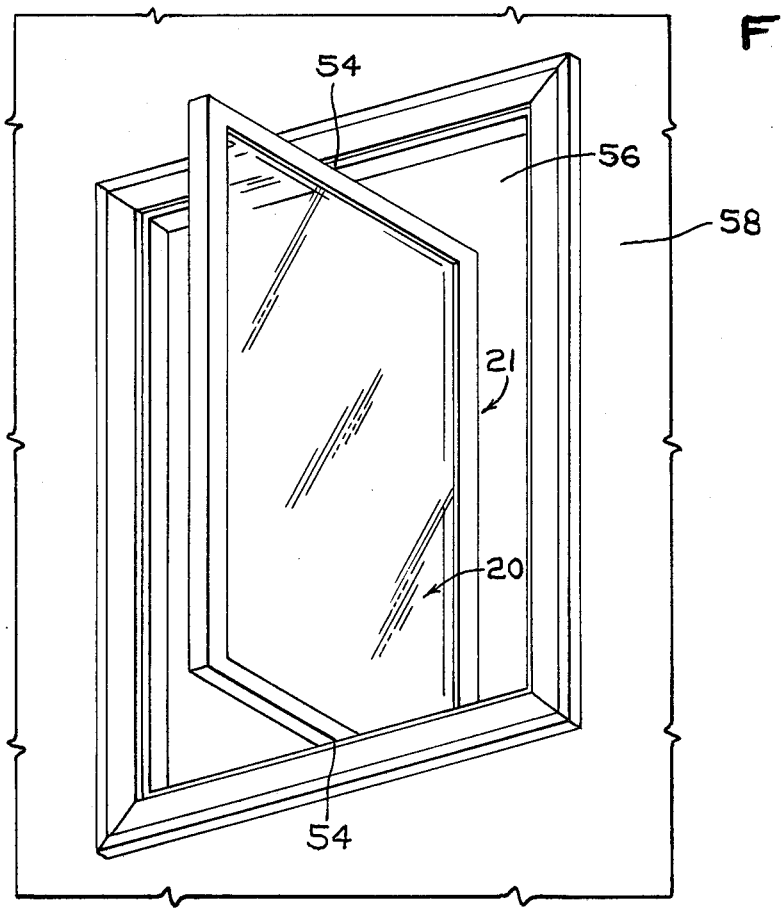
FIG. 2 is an isometric view illustrating the window of FIG. 1 pivotally mounted in a wall opening.

With reference to FIG. 2, the frame 21 having the window 20 is pivotally mounted at 54 in an opening 56 provided in wall structure 58. The hardware for pivotally mounting the frame 21 to make the window reversible is not limiting to the invention and may be any of the types used in the art, for example, but not limited thereto, of the type taught in U.S. Pat. No. 2,889,591 which teachings are hereby incorporated by reference.

The window 21 is shown in FIG. 3 in its summer position with the substrate 22 facing the exterior of the structure and the sun designated by numeral 60; and the substrate 24 facing the interior of the structure or room.

As to solar energy in the visible range, i.e. 0.3 - 0.8 microns incident on the substrate 22, 15–50 percent is reflected to the exterior; 5–50 percent passes through the substrate 22 incident on the insulated unit 26 and the remainder absorbed. Less than 15 percent of the solar energy incident on the unit 26 is reflected toward the substrate 22, at least about 80 percent passes through the insulated unit 26 incident on the substrate 24 and the remainder is absorbed. About 10–15 percent of the solar energy in the wavelength of 0.3 - 0.8 microns incident on the substrate 24 is reflected toward the insulated unit 26; at least about 50 percent, passes into the interior and the remainder is absorbed.

As to solar energy in the infrared range of 0.8 - 15 microns, incident on the substrate 22, at least about 15 percent is reflected to the exterior; less than about 20 percent is transmitted through the window incident on the insulated unit 26 and the remainder absorbed. More than about 10 percent of the solar energy in the wavelength of 0.8 - -microns incident on the unit 26 is reflected toward the substrate 22; less than 80 percent passes through the insulated unit 26 incident on the substrate 24; and the remainder is absorbed. Greater than about 50 percent of the solar energy in the wavelength of 0.8 - 15 microns incident on the substrate 24 is reflected toward the unit 26, less than about 50 percent passes through the substrate 24 and the remainder is absorbed.

From the above discussion, it can be seen that less than about 16 percent of the solar energy in the wavelength of 0.8 - 15 microns incident on the substrate 22 is incident on the substrate 24. Of the 16 percent of incident solar energy, less than about 8 percent is absorbed by the substrate 24. In this manner, the substrate 22 facing the interior is not heated by solar energy to heat the room by conduction. Heat conduction from the substrate 22 and unit 26 is minimized by the dead airspaces.

In the above discussion, secondary reflectance, e.g. between the substrate 22 and insulated unit 26; the substrates 22 and 24; and insulated unit 26 and substrate 24 were not considered for ease of discussion and as being now within the purview of the artisan.

In the summer position, 2–20 percent of the solar energy in the wavelength of 0.3 - 0.8 microns incident on the substrate 22 passes into the room to provide lighting for the room. Less than about 8 percent of the solar energy in the wavelength of 0.8 - 15 microns incident as the substrate 22 passes into the room thereby keeping the room cool.

Heat conduction and/or convection between the exterior and interior of the building is minimized by the airspaces 32, 48 and 34.

If the interior of the structure is air conditioned, heating of the room by solar energy is minimized because (1) less than about 8 percent of the solar energy in the wavelength of 0.8 - 15 microns incident on the exterior of the window passes into the room and (2) heat conduction and convection is minimized by the airspaces 32, 48 and 34 of the window 20.

The window 20 is shown in FIG. 3 in its winter position with the substrate 24 at the exterior of the structure facing the sun 60 and the substrate 22 facing the interior of the structure or room.

As to solar energy in the visible range, i.e. 0.3 - 0.8 microns incident on the substrate 24, less than 50 percent is reflected to the exterior of the window; at least about 50 percent is transmitted through the substrate 24 incident on the insulated unit 26 and the remainder absorbed by the substrate 24. Less than about 15 percent of the solar energy in the wavelength of 0.3 - 0.8 microns incident on the unit 26 is reflected toward the substrate 24; at least about 80 percent passes through the insulated unit 26 incident on the substrate 22 and the remainder is absorbed. About 15–50 percent of the solar energy in the wavelength of 0.3 - 0.8 microns incident on the substrate 22 is reflected toward the insulated unit 26; about 5–50 percent is transmitted through the substrate 22 into the interior; and the remainder is absorbed by the substrate 22.

As to solar energy in the infrared range, for example, 0.8 - 15 microns, incident on the substrate 24 less than 10 percent is reflected toward the exterior of the building; greater than about 40 percent is transmitted through the substrate 24 incident on the insulated unit 26 and the remainder is absorbed. Less than about 15 percent of the solar energy in the wavelength of 0.8 - 15 microns incident on the unit 26 is reflected toward the exterior of the building; more than about 65 percent passes through the insulated unit 26 incident on the substrate 22 and the remainder of the solar energy is absorbed. Less than about 50 percent of the solar energy in the wavelength of 0.8 - 15 microns incident on the substrate 22 is reflected toward the insulated unit 26; greater than 0 percent passes through the substrate 22 into the interior and the remainder is absorbed.

In the above discussion, secondary reflection, e.g. between the substrate 22 and insulated unit 26; the substrates 22 and 24; and insulated unit 26 and substrate 24 were not considered for ease of discussion and as being now within the purview of the artisan.

From the above discussion, it can be seen that in the winter position, about 2–20 percent of the solar energy in the wavelength of 0.3 - 0.8 microns incident on the substrate 24 passes through the window into the room to provide sufficient lighting in the room. Greater than about 13 percent of the solar energy in the wavelength of 0.8 - 15 microns incident on the substrate 24 passes into the room to augment heating of the room.

Greater than 20 percent of the solar energy in the wavelength of 0.8 - 15 microns incident on the substrate 24 is asborbed by the substrate 22 to provide a heated surface for augmenting heating of the room by conduction.

Heat conduction and convection between the exterior and interior of the building is minimized by the dead airspaces 32, 48 and 34 of the window.

As previously discussed, the substrate 24 has a 50 percent reflectance to low temperature radiation in the wavelength greater than 3 microns to minimize heat loss from the room through the window to the exterior of the building.

As can be appreciated, the invention is not limited to the embodiment discussed and other changes may be made within the teachings of the invention. For example, the coating 38 on the substrate 22 may be provided on the adjacent surface of the insulated unit 26 and/or the coating 44 on the surface 46 of the substrate 24 may be applied to the adjacent surface of the insulated unit 26.

DETAILED DESCRIPTION OF THE INVENTION

The invention will be practiced to construct a window in accordance to the teachings of the invention.

A pair of clear glass substrates each having dimensions of 5 feet (1.5 meters) by 3 feet (0.9 meter) and a thickness of one-fourth inch (0.64 centimeter) are coated to provide the glass substrates with the desired characteristics of the invention.

A one of the glass, e.g. sheet 22 shown in FIG. 1, is coated with a silver copper coating having a thickness of 2 - 300 angstroms in accordance to the teachings of U.S. Pat. No. 3,457,138.

The other sheet, e.g. sheet 24, is coated with tin oxide coating having a thickness of about 1,000 - 2,000 angstroms and a resistance of 50 -100 ohm/square in accordance to the teachings of U.S. Pat. No. 2,566,346.

A sealed gas filled unit 26 manufactured according to the teachings of U.S. Pat. No. 3,683,974 has outer dimensions of 5 feet (1.5 meters) and 3 feet (0.9 meter). The airspace 48 is 3/16 inch (0.48 centimeter) wide and glass substrates 50 and 52 are each one-fourth inch (0.64 centimeter) thick.

A spacer frame 60 made of section of lock seam spacers having a desiccant 62 therein is provided in accordance to the teachings of U.S. Pat. No. 2,684,266. The spacer frame 60 has a thickness of about one-half inch (1.27 centimeters) and outer dimensions of 5 feet (1.5 meters) by 3 feet (0.8 meter).

A one of the spacer frames 60 is positioned between the marginal edge portion of the glass sheet 52 of the insulated unit 26 and substrate 22. The other one of the spacer frames 60 is positioned between the marginal edge portions of the substrate 24 and the glass sheet 50 of the insulated unit. The coating 38 on the substrate 22 and the coating 44 on the substrate 24 face the substrates 52 and 50, respectively, of the insulated unit as shown in FIGS. 1, 3 and 4.

The marginal edges of the substrates 22 and 24 and insulated units 26 are sealed to provide moisture-free, dead airspaces 32 and 34 as shown in FIG. 1. The marginal edges of the substrate and units 26 may be sealed in accordance to the teachings of U.S. Pat. Nos. 3,919,023 or 3,758,996.

The sealed window 20 is mounted in a frame 21 in any conventional manner and thereafter pivotally mounted in opening 56 of a wall 58 as taught in U.S. Pat. No. 2,889,591.

In the summer position as shown in FIG. 3, the window 20 has a U-value of 0.213 BTU/hour-square foot-° F. and a Shading Coefficient of 0.145. The substrate 22, insulated unit 26, and substrate 24 have reflectance, transmission and absorption to solar energy as shown in Table IV.

TABLE IV

| Window 21 in the summer position | SOLAR ENERGY Visible Range 0.3 - 0.8 microns reflectance | transmission | absorption | Infrared Range 0.8 - 15 microns reflectance | transmission | absorption |
|---|---|---|---|---|---|---|
| substrate 22 | 38% | 20% | 42% | 46% | 4.2% | 49.8% |
| insulated Unit 26 | 14% | 80% | 6% | 14% | 76% | 10% |
| substrate 24 | 13% | 72.7% | 14.3% | 8.5% | 45% | 46.5% |

In the winter position as shown in FIG. 4, the window 20 has a U-value of 0.234 BTU/hour-square foot-° F. and a Shading Coefficient of 0.281. The substrate 24, insulated unit 26, and substrate 22 have reflectance, transmission, and absorption values to solar energy as shown in Table V.

TABLE V

| Window 21 in the winter position | SOLAR ENERGY Visible Range 0.3 - 0.8 microns reflectance | transmission | absorption | Infrared Range 0.8 - 15 microns reflectance | transmission | absorption |
|---|---|---|---|---|---|---|
| substrate 24 | 11.8% | 72.7% | 15.5% | 7.7% | 45% | 47.3% |
| insulated Unit 26 | 14% | 80% | 6% | 14% | 76% | 10% |
| substrate 22 | 44% | 20% | 36% | 46% | 4.2% | 49.8% |

In addition, the substrate 24 has a 50 percent reflectance to low temperature radiation in the wavelength of greater than 3 microns.

In the summer position, 12.6 percent of the solar energy in the wavelength of 0.3 - 0.8 microns incident on the substrate 22 passes through the window into the room; and 1.4 percent of the solar energy in the wavelength of 0.8 - 15 microns incident on the substrate 22 passes through the window into the room.

In the summer position, only 1.5 percent of the solar energy in the wavelength of 0.8 - 15 microns incident on the substrate 22 is absorbed by the substrate 24 to minimize work load on the air conditioners and keep the room cool.

In the winter position, 22 percent of the solar energy in the wavelength of 0.8 – 15 microns incident on the substrate 24 is absorbed by the substrate 22 to augment heating of the room.

Although the invention was directed to a specific embodiment, it can now be appreciated that the invention is not limited thereto and changes may be made without deviating from the scope of the invention.

What is claimed is:

1. A seasonably adjustable window, comprising:

a first transparent substrate;

a second transparent substrate;

a third transparent substrate;

a fourth transparent substrate;

means for sealing said transparent substrates to provide (1) moisture-free, dead airspaces between said first and second substrates; said second and third substrates; and said third and fourth substrates; and (2) a first half including said first and second substrates and a second half including said third and fourth substrates;

a first selective coating on said first half;

a second selective coating on said second half; and said first and second selective coatings (1) provide said window in a first position with a Shading Coefficient of less than about 0.20 and a U-value of less than about 0.250 BTU/hour-square foot-° F.; and (2) provide said window in a second opposite position with a Shading Coefficient of greater than about 0.25; a U-value of less than about 0.250 BTU/hour-square foot-° F.; and (3) about 50 percent reflectance to low temperature radiation in the wavelength of greater than about 3 microns.

2. The window as set forth in claim 1 further including means for pivotally mounting the window in a wall opening to position the window in the first or second position.

3. The window as set forth in claim 1 wherein said first selective coating is on said first substrate and said second selective coating is on said fourth substrate.

4. The window as set forth in claim 3 wherein less than about 8 percent of solar energy in the wavelength of about 0.8 – 15 microns incident on said coated first substrate is absorbed by said coated fourth substrate; and more than about 20 percent of solar energy in the wavelength of about 0.8 – 15 microns incident on said coated fourth substrate is absorbed by said coated first substrate.

5. The window as set forth in claim 4 wherein about 1.4 percent of the solar energy in the wavelength of about 0.8 – 15 microns incident on said coated first substrate is absorbed by said coated fourth substrate and about 22 percent of the solar energy incident on said coated fourth substrate is absorbed by said coated first substrate.

6. The window as set forth in claim 5 wherein said substrates are made of glass and said first selective coating is on the interior surface of said first glass substrate and said second selective coating is on the interior surface of said fourth substrate.

7. The window as set forth in claim 3 wherein the window is in the first position and said coated first substrate as to solar energy in the wavelength of about 0.8 – 15 microns has at least about 15 percent reflectance; less than about 15 percent transmission and the remainder absorbed; said second and third substrates as to solar energy in the wavelength of about 0.8 – 15 microns has at least about 10 percent reflectance; less than about 8 percent transmission and the remainder absorbed; and said coated fourth substrate as to solar energy in the wavelength of about 0.8 – 15 microns has greater than about 5 percent reflectance; less than about 50 percent transmission and the remainder absorbed.

8. The window as set forth in claim 7 wherein said coated first substrate has about 46 percent reflectance; about 4.2 percent transmission; and about 49.8 percent absorption; said second and third substrates have about 14 percent reflectance; about 76 percent transmission and about 10 percent absorption; and said coated fourth substrate has about 8.5 percent reflectance; about 45 percent transmission and about 46.5 percent absorption.

9. The window as set forth in claim 7 wherein said coated first substrate as to solar energy in the wavelength of about 0.3 – 0.8 microns has about 15–20 percent reflectance; about 5–50 percent transmission and the remainder absorbed; said second and third substrates as to solar energy in a wavelength of about 0.3 – 0.8 microns has less than about 15 percent reflectance; at least about 80 percent transmission; and the remainder absorbed; said coated fourth substrate as to solar energy in the wavelength range of about 0.3 – 0.8 microns has about 10–15 percent reflectance; at least about 50 percent transmission and the remainder absorbed.

10. The window as set forth in claim 8 wherein said coated first substrate as to solar energy in the wavelength of about 0.3 – 0.8 microns has about 38 percent reflectance; about 20 percent transmission and about 42 percent absorption; said second and third substrates as to solar energy in the wavelength of about 0.3 – 0.8 microns has about 14 percent reflectance; about 80 percent transmission and about 6 percent absorption; and said coated fourth substrate as to solar energy in the wavelength of about 0.3 – 0.8 microns has about 13 percent reflectance; about 72.7 percent transmission; and about 14.3 percent absorption.

11. The window as set forth in claim 3 wherein the window is in the second position and said coated fourth substrate as to solar energy in the wavelength of about 0.8 – 15 microns has greater than about 5 percent reflectance; less than about 50 percent transmission and the remainder absorbed; said third and second substrates as to solar energy in the wavelength of about 0.8 – 15 microns has less than about 15 percent reflectance; more than about 65 percent transmission and the remainder absorbed; said coated first substrate as to solar energy in a wavelength of about 0.8 – 15 microns has less than about 50 percent reflectance; greater than 0 percent transmission and the remainder absorbed.

12. The window as set forth in claim 11 wherein said coated fourth substrate has about 7.7 percent reflectance; about 45 percent transmission and about 47.3 percent absorption; said third and fourth substrate has about 14 percent reflectance; about 76 percent transmission and about 10 percent absorption; and said coated first substrate has about 46 percent reflectance; about 4.2 percent transmission and about 49.8 percent absorption.

13. The window as set forth in claim 11 wherein said coated fourth substrate as to solar energy in the wavelength of about 0.3 – 0.8 microns has less than about 15 percent reflectance; at least about 50 percent transmission and the remainder absorbed; said third and second substrates as to solar energy in the wavelength of about 0.3 – 0.8 microns has less than about 15 percent reflectance; at least about 80 percent transmission and the remainder absorbed; and said coated first substrate as to solar energy in the wavelength of about 0.3 – 0.8 microns has about 15–50 percent reflectance; about 5–50 percent transmission and the remainder absorbed.

14. The window as set forth in claim 12 wherein said coated fourth substrate as to solar energy in the wavelength of about 0.3 – 0.8 microns has about 11.8 percent reflectance; about 72.7 percent transmission and about 15.15 percent absorption; said third and second substrates as to solar energy in the wavelength of about 0.3 – 0.8 microns has about 14 percent reflectance; about 80 percent transmission and about 6 percent absorption; said coated first substrate as to solar energy in the wavelength of about 0.3 – 0.8 microns has about 44 percent reflectance; about 20 percent transmission and about 36 percent absorption.

15. The window as set forth in claim 13 wherein said substrates are made of glass; said second and third substrates have their edges welded together and are filled with a gas, said first and fourth substrates are spaced from the second and third substrate respectively by a spacer.

16. The window as set forth in claim 1 wherein said first substrate has its inner surface coated with a metal coating and said fourth substrate has its inner surface coated with a metal oxide coating.

17. The window as set forth in claim 15 wherein the first position is the summer position and the second position is the winter position.

18. A seasonably adjustable window, comprising:

a plurality of transparent substrates;

means for sealing edges of said plurality of transparent substrates to provide a sealed multipane unit having (1) at least one dead airspace between said plurality of transparent panes; and (2) a first outer surface and a second outer surface opposite to the first outer surface; and selective coating on selected ones of said plurality of transparent substrates to provide said multipane unit (1) with a shading coefficient of less than about 0.20 when the first surface of said multipane unit is in a first predetermined position and the second surface of said multipane unit is in a second predetermined position and (2) with a shading coefficient of greater than about 0.25 when the second surface of said multipane unit is in the first predetermined position and the first surface of the said multipane unit is in the second predetermined position.

19. The window as set forth in claim 18 wherein said multipane unit has a U-value of less than about 0.250 BTU/hour-square foot-° F.

20. The window as set forth in claim 18 wherein said multipane unit has about 50 percent reflectance to low temperature radiation in the wavelength of greater than about 3 microns.

21. The window as set forth in claim 18 further including means for pivotally mounting said multipane unit in a wall opening to position said multipane unit in the first or second predetermined position.

22. The window as set forth in claim 18 wherein a selective coating is on a one of the substrates to provide a coated first substrate and a selective coating is on a second one of the substrates to provide a coated second substrate;

less than about 8 percent of solar energy in the wavelength of about 0.8 – 15 microns incident on said coated first substrate is absorbed by said coated second substrate; and more than about 20 percent of solar energy in the wavelength of about 0.8 – 15 microns incident on said coated second substrate is absorbed by said coated first substrate.

23. The window as set forth in claim 18 wherein a selective coating is on a one of the substrates to provide a coated first substrate and a selective coating is on a second one of the substrates to provide a coated second substrate; and about 2–20 percent of solar energy in the wavelength of about 0.3 – 0.8 microns incident on said multipane unit passes through said multipane unit.

24. The window as set forth in claim 18 wherein said multipane unit is (1) in the summer position when said first substrate is in the predetermined first position and (2) in the winter position when said second substrate is in the predetermined second position.

25. The window as set forth in claim 18 wherein a one of said substrates is coated with a metal coating and a one of said substrates is coated with a metal oxide coating.

* * * * *